US012465094B2

(12) United States Patent
Turner

(10) Patent No.: US 12,465,094 B2
(45) Date of Patent: Nov. 11, 2025

(54) PANTS WITH REMOVABLE FLAP WITH LINER AND BANDS

(71) Applicant: Erin E. Turner, Belmont, NC (US)

(72) Inventor: Erin E. Turner, Belmont, NC (US)

( * ) Notice: Subject to any disclaimer, the term of this patent is extended or adjusted under 35 U.S.C. 154(b) by 0 days.

(21) Appl. No.: 18/590,350

(22) Filed: Feb. 28, 2024

(65) Prior Publication Data

US 2024/0292913 A1 Sep. 5, 2024

Related U.S. Application Data

(60) Provisional application No. 63/488,075, filed on Mar. 2, 2023.

(51) Int. Cl.
*A41D 1/06* (2006.01)
*A41D 27/02* (2006.01)

(52) U.S. Cl.
CPC ..... *A41D 1/06* (2013.01); *A41D 27/02* (2013.01); *A41D 2300/32* (2013.01); *A41D 2300/322* (2013.01); *A41D 2300/324* (2013.01); *A41D 2500/00* (2013.01)

(58) Field of Classification Search
CPC ..... A41B 9/007; A41D 1/065; A41D 1/06; A61F 13/70; A61F 13/76; A61F 13/72
USPC ..... 604/395; 2/408; 450/103
See application file for complete search history.

(56) References Cited

U.S. PATENT DOCUMENTS 3,704,710 A * 12/1972 Fifer ..... A61F 13/72 604/398
4,961,234 A * 10/1990 Leibman ..... A41D 1/06 2/408
2008/0216203 A1* 9/2008 Duncan ..... A41D 1/086 2/22
2013/0125293 A1* 5/2013 Stearns ..... A41D 1/06 2/227
2017/0099887 A1* 4/2017 Boillat-Macon ... A41D 13/1254
2018/0318142 A1* 11/2018 Gagliardo ..... A41F 9/00
2021/0052021 A1* 2/2021 Davis ..... A41D 1/065

* cited by examiner

*Primary Examiner* — Khoa D Huynh
*Assistant Examiner* — Grady Alexander Nunnery
(74) *Attorney, Agent, or Firm* — Jeffrey C. Watson, Esq.; Grell & Watson Patent Attorneys LLC

(57) ABSTRACT

A pair of pants with a removable flap with a liner and bands includes an open crotch area in the pair of pants, and a removable flap. The removable flap is configured to cover the open crotch area in the pair of pants. The removable flap includes a front end and a back end. The front end of the removable flap is configured to be removably fastened on or near the waistband of the pair of pants on a frontside of the waistband of the pair of pants. The back end of the removable flap is configured to be removably fastened on or near the waistband of the pair of pants on a backside of the waistband of the pair of pants. The removable flap is configured to be removed from either the frontside of the waistband and/or the backside of the waistband.

1 Claim, 6 Drawing Sheets

PANTS WITH REMOVABLE FLAP WITH LINER AND BANDS

CROSS-REFERENCE TO RELATED APPLICATIONS

This application claims benefit to U.S. Provisional Patent Application No. 63/488,075 filed on Mar. 2, 2023, entitled PANTS WITH REMOVABLE FLAP WITH LINER AND BANDS, which is incorporated by reference in its entirety.

FIELD OF THE DISCLOSURE

The present disclosure relates to clothing, namely, pants. More specifically, the present disclosure relates to pants with a removable flap that includes a liner and bands.

BACKGROUND

Generally speaking, pants, also known as trousers or slacks, are an item of clothing worn from the waist to anywhere between the knees and the ankles, covering both legs separately (rather than with cloth extending across both legs as in robes, skirts, dresses and kilts). Pants are worn on the hips or waist and are often held up by buttons, elastic, a belt or suspenders (braces). Shorts are similar to pants, but with legs that come down only to around the area of the knee, higher or lower depending on the style of the garment. Shorts are often preferred in hot weather or for some sports and also often by the youth. Pants are the most common form of lower-body clothing for adults in the modern world. Jeans, made of denim, are a form of pants for casual wear widely worn all over the world by both sexes. Jeans usually feature side and rear pockets with pocket openings placed slightly below the waist band. It is also possible for pants to provide cargo pockets further down the legs. Since the mid-twentieth century, pants have increasingly been worn by women. The instant disclosure may be directed toward pants or shorts that are ideal for women.

Unless elastic, pants usually provide a zippered or buttoned fly. This zippered or buttoned fly has 2 functions: first to make the pants easier to put on and/or remove; and second to allow males to urinate without removing or dropping their pants. This second function is only applicable for males, and women do not have such an option and typically must remove or drop their pants in order to urinate or use the bathroom. In public restrooms or out in the environment, this can become very problematic for women as they are required to drop their pants in some unsanitary locations thereby soiling their pants making them undesirable to wear after using the restroom. The instant disclosure recognizes the need and desire to provide pants and/or shorts that allow women to use the restroom without the need to remove or drop their pants to the ground.

In addition, women also have the need to change, add, or adjust sanitary napkins. When wearing standard pants, this process also typically requires the women to remove or drop their pants to change, add, or adjust such sanitary napkins. Similar to using the restroom, in public restrooms or out in the environment, this can become very problematic for women as they are required to drop their pants in some unsanitary locations thereby soiling their pants making them undesirable to wear after changing, adding, or adjusting their sanitary napkin. The instant disclosure recognizes the need and desire to provide pants and/or shorts that allow women to change, add and/or adjust sanitary napkins without the need to remove or drop their pants to the ground.

Another problem women occur with sanitary napkins is holding them in place while being warn and moving around. As such, there is clearly a need to provide a device or means for aiding women in holding sanitary napkins in place.

The instant disclosure may be designed to address at least certain aspects of the problems or needs discussed above by providing pants with a removable flap with a liner and bands.

SUMMARY

The present disclosure may solve the aforementioned limitations of the currently available pants, by providing the disclosed pants with a removable flap with a liner and bands. The disclosed pants with a removable flap with a liner and bands may generally include an open crotch area in the pair of pants, and a removable flap. The removable flap may be configured to cover the open crotch area in the pair of pants.

In select embodiments of the disclosed pair of pants, the removable flap may include a front end or a back end. The front end of the removable flap may be configured to be removably fastened on or near the waistband of the pair of pants on a frontside of the waistband of the pair of pants. Or the back end of the removable flap may be configured to be removably fastened on or near the waistband of the pair of pants on a backside of the waistband of the pair of pants. Wherein, the removable flap may be configured to be removed from either the frontside of the waistband or the backside of the waistband.

In select embodiments of the disclosed pair of pants, the removable flap may include the front end and the back end. The front end of the removable flap may be configured to be removably fastened on or near the waistband of the pair of pants on a frontside of the waistband of the pair of pants. The back end of the removable flap may be configured to be removably fastened on or near the waistband of the pair of pants on a backside of the waistband of the pair of pants. Wherein, the removable flap may be configured to be removed from the frontside of the waistband and/or the backside of the waistband. Whereby, the removable flap may be configured to be removed or attached from either the frontside to the backside or the backside to the frontside, as desired.

One feature of the disclosed pair of pants may be that when the removable flap is positioned over the open crotch area of the pair of pants with the front end of the removable flap fastened on or near the waistband of the pair of pants on the frontside of the waistband and the back end of the removable flap fastened on or near the waistband of the pair of pants on the backside, the removable flap may be configured to conceal the open crotch area of the pair of pants.

Another feature of the disclosed pair of pants may be that when the removable flap may be removed from the pair of pants by unfastening the front end and/or the back end of the removable flap from the waistband, the open crotch area of the pair of pants may be uncovered. This feature may allow the wearer to use the restroom without removing or dropping the pair of pants and/or may allow the wearer to change, add, and/or adjust a sanitary napkin without the need to remove or drop the pair of pants.

In select embodiments of the disclosed pair of pants, the front end of the removable flap and the corresponding frontside of the waistband of the pair of pants may include a front removable connection. The front removable connection may be, but is not limited to, a front hoop and loop type fastener connection, a front plurality of buttons connection, a front plurality of snaps connection, the like, and/or any various combinations thereof. Likewise, in select embodiments of the disclosed pair of pants, the back end of the removable flap and the corresponding backside of the waistband of the pair of pants may include a back removable connection. The back removable connection may be, but is not limited to, a back hoop and loop type fastener connection, a back plurality of buttons connection, a back plurality of snaps connection, the like, and/or any various combinations thereof.

Another feature of the disclosed pair of pants may be that the open crotch area and the removable flap of the pair of pants may be designed and configured to allow women to have ease in using the restroom without the need to remove the entire pair of pants.

Another feature of the disclosed pair of pants may be that the open crotch area and the removable flap of the pair of pants may be designed and configured to allow women to easily change, add, and/or adjust sanitary napkins.

Another feature of the disclosed pair of pants may be that the open crotch area and the removable flap of the pair of pants may be designed and configured to allow women to have ease in using the restroom without the need to remove the entire pair of pants and to allow women to easily change, add, or adjust sanitary napkins.

In select embodiments of the disclosed pair of pants, the removable flap may include a lining material. The lining material may be on an underside of the removable flap. The lining material may be configured to be breathable and/or comfortable and/or to absorb any moisture on the underside of the removable flap. In select embodiments, the lining material on the underside of the removable flap may be a cotton material. Wherein, the removable flap with a cotton lined underside may be configured to eliminate the need to wear underwear under the pair of pants.

In select embodiments of the disclosed pair of pants, the removable flap may include at least one band on an underside of the removable flap. The at least one band may be configured to secure a sanitary napkin, or the like, on the underside of the removable flap. In select embodiments, each of the bands may be made from a soft elastic band material. In select embodiments, the removable flap may include two bands on the underside of the removable flap. The two bands may include a front band and a back band. The front band may be positioned between a middle and the front end of the removable flap. The back band may be positioned between the middle and the back end of the removable flap. Wherein, the two bands may be configured to secure the sanitary napkin in two securing locations along the underside of the removable flap.

In select embodiments of the pair of pants, the removable flap may include a left flap side and a right flap side. The left flap side of the removable flap may be designed to be removably fastened to a left crotch side of the open crotch area of the pants from a frontside of the waistband down between the legs and up to a backside of the waistband. Likewise, the right flap side of the removable flap may be designed to be removably fastened to a right crotch side of the open crotch area of the pants from the frontside of the waistband down between the legs and up to the backside of the waistband. In select embodiments, the left flap side of the removable flap and the left crotch side of the open crotch area may include a left side fastening strip. The left side fastening strip may be, but is not limited to, a left side hook and loop type fastener, a left side zipper fastener, the like, and/or any various combinations thereof. Likewise, the right flap side of the removable flap and the right crotch side of the open crotch area may include a right side fastening strip. The right side fastening strip may be, but is not limited to, a right side hook and loop type fastener, a right side zipper fastener, the like, and/or any various combinations thereof. Wherein, the right side fastening strip and the left side fastening strip may be configured to prevent gapping between the removable flap and the open crotch area of the pair of pants.

In select embodiments of the disclosed pair of pants, the removable flap may include an hourglass shape. The hourglass shape of the removable flap may include a front large width at a front end, a narrow middle width at a middle, and a back large width at a back end. Similarly, the open crotch area may have a corresponding opening shape configured to match the hourglass shape of the removable flap. This corresponding opening shape of the open crotch area may include a front wide opening approximate the frontside of the waistband, a narrow middle opening between the legs of the pants, and a back wide opening approximate the backside of the waistband.

One feature of the disclosed pair of pants may be that they can be designed and/or configured to hold sanitary napkins in place during hiking or other highly physical activities.

Another feature of the disclosed pair of pants may be that they can be designed and/or configured to be safer and faster in using the bathroom in public or outdoor locations, such as camping or public events like festivals with long restroom lines, or for women who have to work outdoors, like female construction workers, police officers, firefighters, military personnel, etc.

Another feature of the disclosed pair of pants may be that they can be designed and/or configured to avoid direct contact with restrooms that may not be sanitary.

Another feature of the disclosed pair of pants may be that they can be designed and/or configured to have the removable flap be exchanged for a mix and match look.

Another feature of the disclosed pair of pants may be the inclusion of a faux zipper front. This faux zipper front may be designed and configured to make the disclosed pair of pants look normal so that wearers don't have to have pants that look different.

Another feature of the disclosed pair of pants may be that they can be designed and/or configured to be used with much greater ease for people with disabilities, dexterity or mobility issues, either for more independence or to make it faster and easier for caretakers to assist with dressing and bathroom needs.

Another feature of the disclosed pair of pants may be that they can be designed and/or configured to provide the ability to use the removeable flap to change out completely to replace soiled flaps or to simply push the flap to the side or pushing front to back or back to front is faster and easier and allows the wearer to experience not only more efficiency, but dignity.

In another aspect, the instant disclosure embraces the disclosed pair of pants in any of the various embodiments and/or combinations of embodiments shown and/or described herein.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWING

The present disclosure will be better understood by reading the Detailed Description with reference to the accompanying drawings, which are not necessarily drawn to scale, and in which like reference numerals denote similar structure and refer to like elements throughout, and in which.

Figure 1:
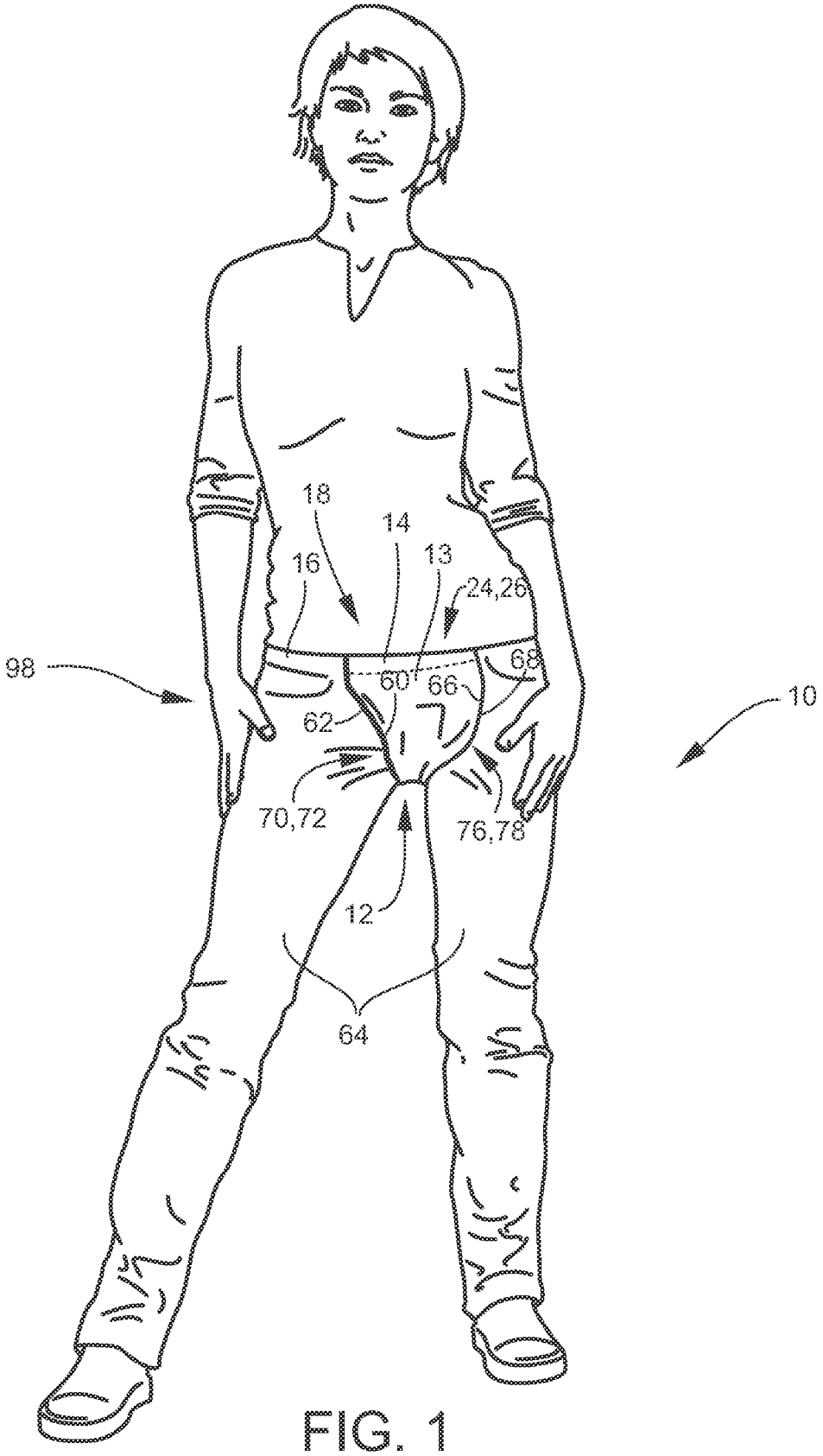
FIG. 1 is an environmental front perspective view of the disclosed pants with a removable flap with a liner and bands according to select embodiments of the instant disclosure being warn.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-7, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Referring to FIGS. 1-7, the present disclosure may solve the aforementioned limitations of the currently available garments or pants by providing the disclosed pair of pants 10 with removable flap 13 with liner 41 and bands 46. Pair of pants 10 may be any style of pants, including, but not limited to, any pants, slacks, jeans, trousers, shorts, bathing suit bottoms, the like, or any other applicable apparel bottoms. Pair of pants 10 with removable flap 13 with liner 41 and bands 46 may generally include open crotch area 12 in pair of pants 10, and removable flap 13. Removable flap 13 may be configured to cover open crotch area 12 in pair of pants 10.

In select embodiments of pair of pants 10, removable flap 13 may include front end 14 and/or back end 20. Front end 14 of removable flap 13 may be configured to be removably fastened on or near waistband 16 of pair of pants 10 on frontside 18 of waistband 16 of pair of pants 10. Or back end 20 of removable flap 13 may be configured to be removably fastened on or near waistband 16 of pair of pants 10 on backside 22 of waistband 16 of pair of pants 10. Wherein, removable flap 13 may be configured to be removed from either frontside 18 of waistband 16 and/or backside 22 of waistband 16.

As shown in the Figures, in select possibly preferred embodiments of pair of pants 10, removable flap 13 may include front end 14 and back end 20. Front end 14 of removable flap 13 may be configured to be removably fastened on or near waistband 16 of pair of pants 10 on frontside 18 of waistband 16 of pair of pants 10. Back end 20 of removable flap 13 may be configured to be removably fastened on or near waistband 16 of pair of pants 10 on backside 22 of waistband 16 of pair of pants 10. Wherein, removable flap 13 may be configured to be removed from frontside 18 of waistband 16 and/or backside 22 of waistband 16. Whereby, removable flap 13 may be configured to be removed or attached from either frontside 18 to backside 22 or backside 22 to frontside 18, as desired. Accordingly, removeable flap 13 does not need to be removed in every situation, but it can remain fastened on front end 14 and/or back end 20 and tucked into waistband 16 or draped over an arm as desired by the wearer to use the bathroom.

Figure 2:
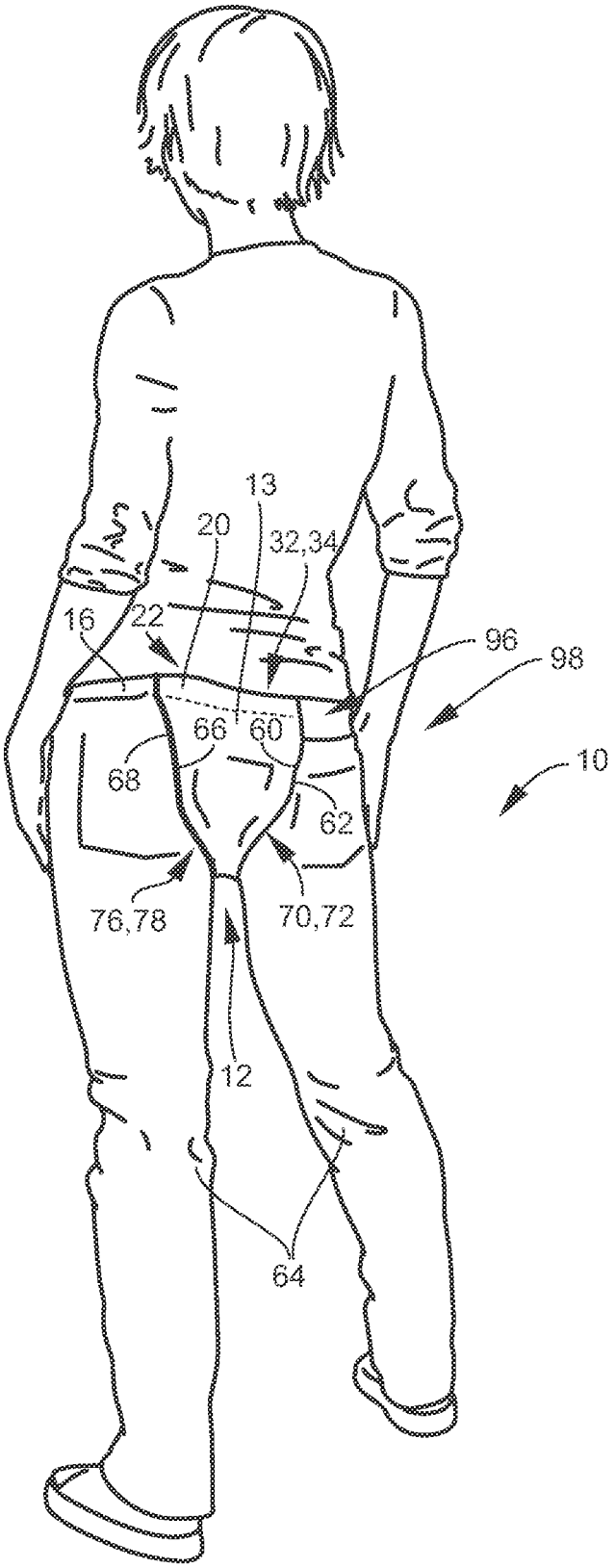
FIG. 2 is an environmental back perspective view of the pants with a removable flap with a liner and bands from FIG. 1.

As best shown in FIGS. 1 and 2, one feature of pair of pants 10 may be that when removable flap 13 is positioned over open crotch area 12 of pair of pants 10 with front end 14 of removable flap 13 fastened on or near waistband 16 of pair of pants 10 on frontside 18 of waistband 16 and back end 20 of removable flap 13 fastened on or near waistband 16 of pair of pants 10 on backside 22, removable flap 13 may be configured to conceal open crotch area 12 of pair of pants 10.

Figure 3:
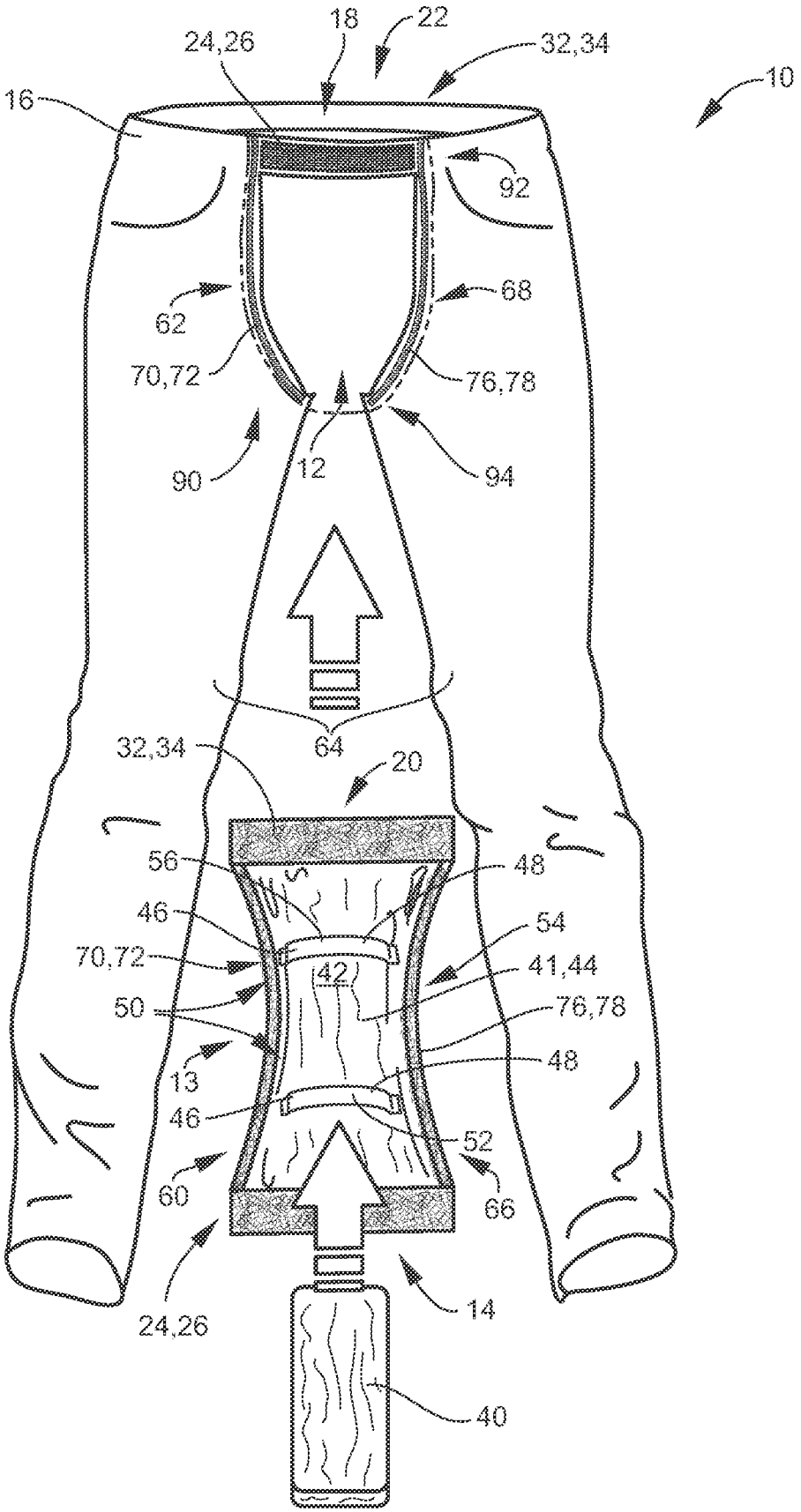
FIG. 3 is a front perspective view of the disclosed pants with a removable flap with a liner and bands from FIG. 1 showing the removable flap removed and its operation with hood and loop type fasteners on the front end and the back end and hook and loop type fasteners along both sides.
Figure 6A:
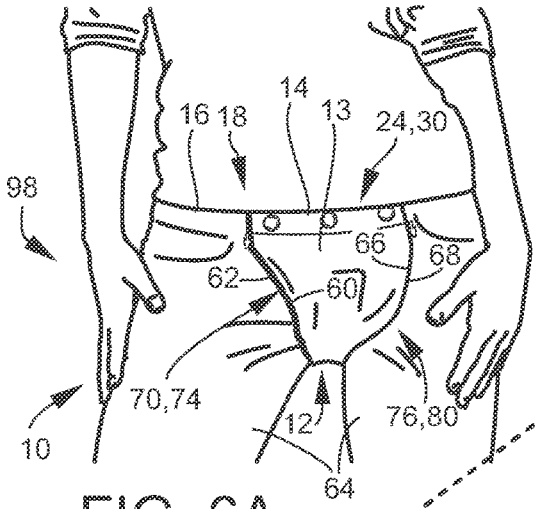
FIG. 6A is an environmental front perspective view of the disclosed pants with a removable flap with a liner and bands according to select embodiments of the instant disclosure being warn.
Figure 6B:
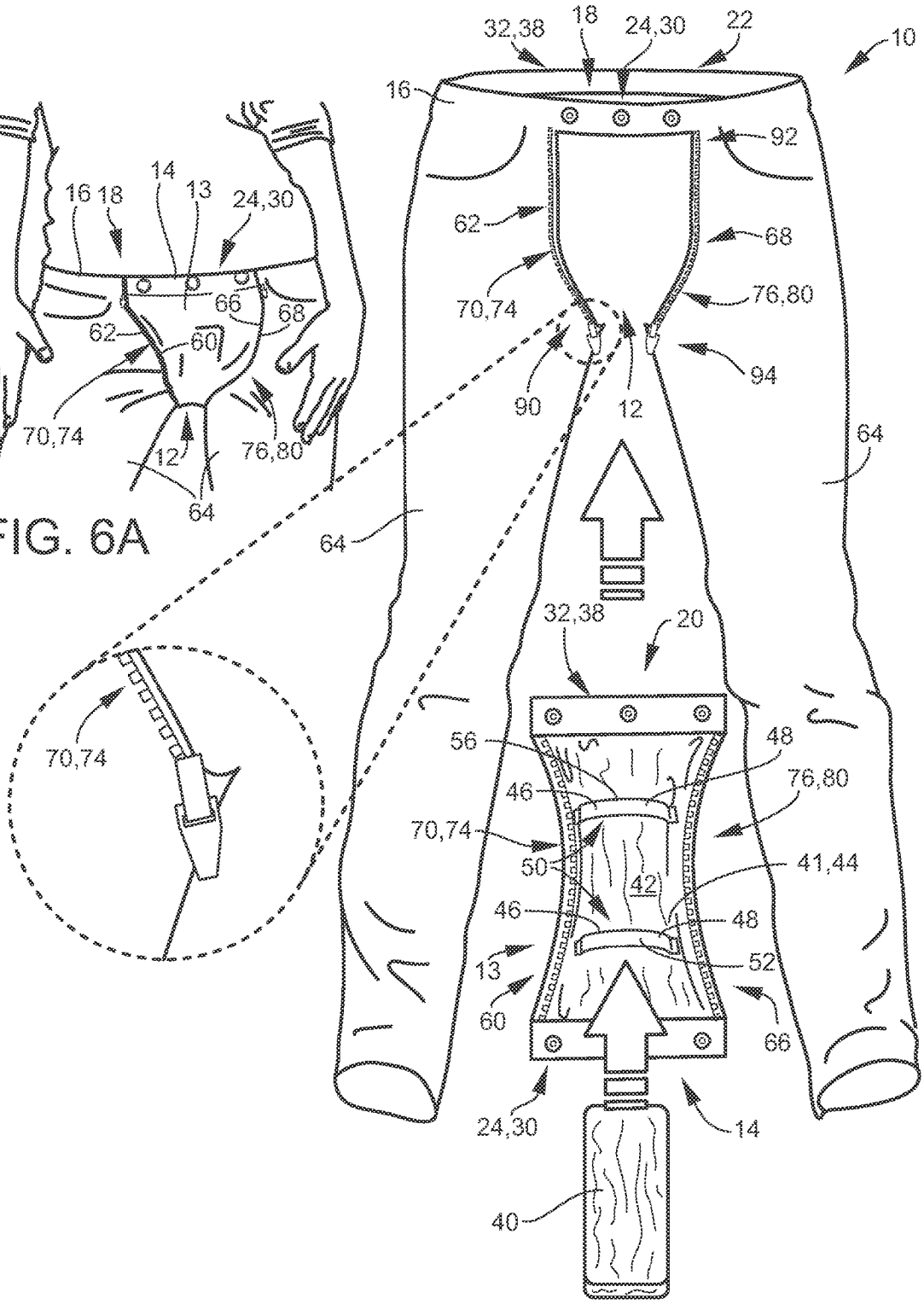
FIG. 6B is a front perspective view of the disclosed pants with a removable flap with a liner and bands of FIG. 6A showing the removable flap removed and its operation with a plurality of snap fasteners on the front end and the back end and zipper fasteners along both sides.
Figure 7A:
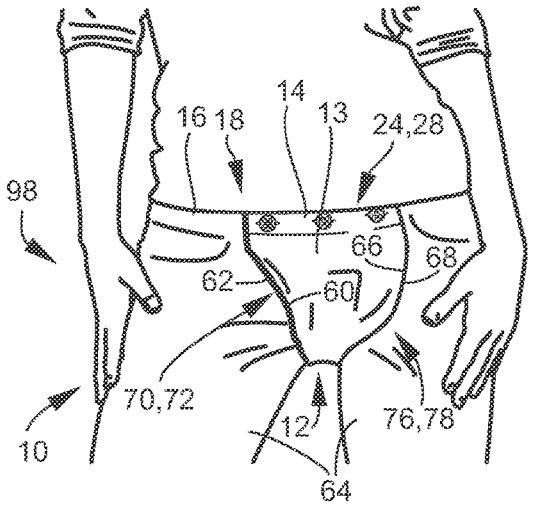
FIG. 7A is an environmental front perspective view of the disclosed pants with a removable flap with a liner and bands according to select embodiments of the instant disclosure being warn.
Figure 7B:
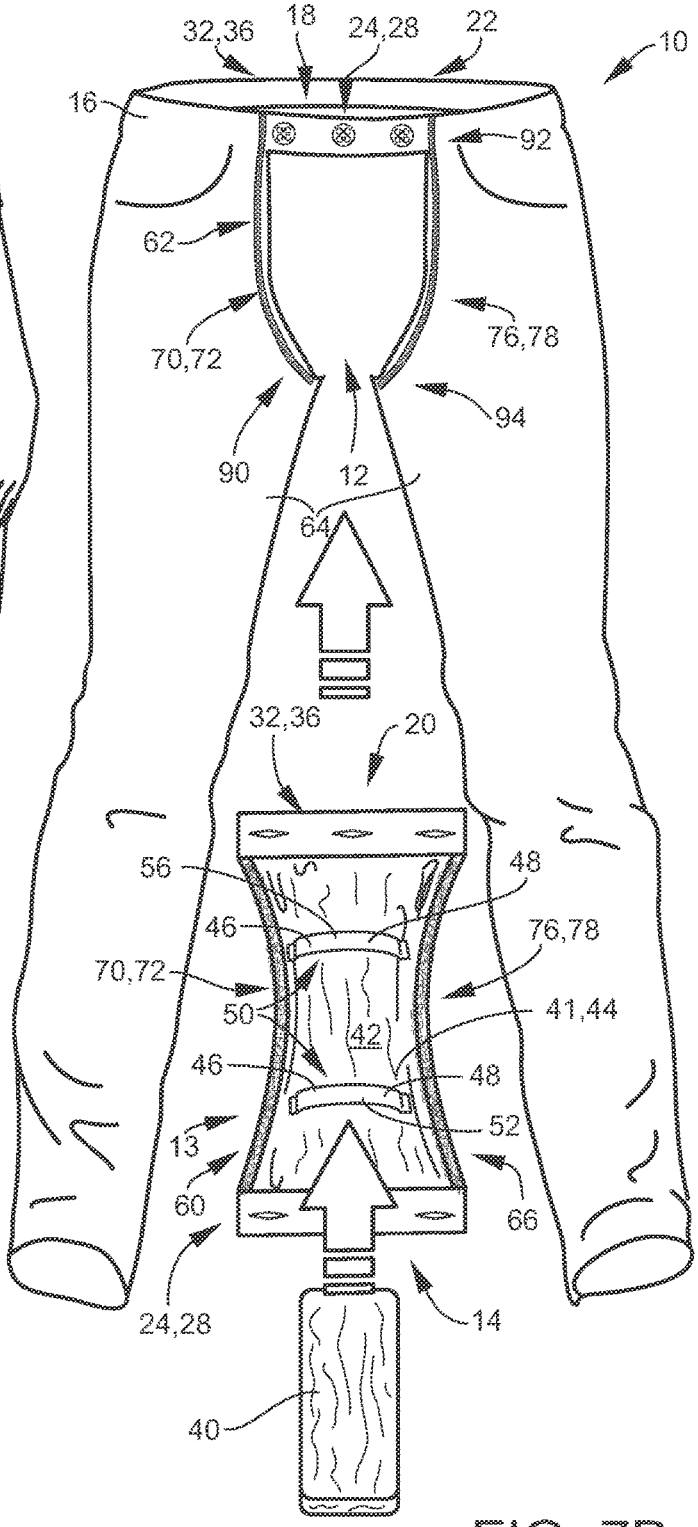
FIG. 7B is a front perspective view of the disclosed pants with a removable flap with a liner and bands of FIG. 7A showing the removable flap removed and its operation with a plurality of button fasteners on the front end and the back end and hook and loop type fasteners along both sides.

As best shown in FIGS. 3, 6B and 7B, another feature of pair of pants 10 may be that when removable flap 13 may be removed from pair of pants 10 by unfastening front end 14 and/or back end 20 of removable flap 13 from waistband 16, open crotch area 12 of pair of pants 10 may be uncovered. As examples, and clearly not limited thereto, this feature may allow the wearer to use the restroom without removing or dropping pair of pants 10 and/or may allow the wearer to change, add, and/or adjust a sanitary napkin without the need to remove or drop pair of pants 10.

As best shown in FIGS. 3, 6B and 7B, in select embodiments of pair of pants 10, front end 14 of removable flap 13 and the corresponding frontside 18 of waistband 16 of pair of pants 10 may include front removable connection 24. Front removable connection 24 may be any type or means of providing a removable connection between front end 14 of removable flap 13 and frontside 18 of waistband 16 of pair of pants 10. As examples, and clearly not limited thereto, in select embodiments, front removable connection 24 may be front hoop and loop type fastener connection 26 (see FIGS. 1-5), front plurality of buttons connection 28 (see FIGS. 7A and 7B), front plurality of snaps connection 30 (see FIGS.

6A and 6B), the like, and/or any various combinations thereof. Likewise, in select embodiments of pair of pants 10, back end 20 of removable flap 13 and the corresponding backside 22 of waistband 16 of pair of pants 10 may include back removable connection 32. Back removable connection 32 may be any type or means of providing a removable connection between back end 20 of removable flap 13 and backside 22 of waistband 16 of pair of pants 10. As examples, and clearly not limited thereto, in select embodiments, back removable connection 32 may be back hoop and loop type fastener connection 34 (see FIGS. 1-5), back plurality of buttons connection 36 (see FIGS. 7A and 7B), back plurality of snaps connection 38 (see FIGS. 6A and 6B), the like, and/or any various combinations thereof.

Another feature of pair of pants 10 may be that open crotch area 12 and removable flap 13 of pair of pants 10 may be designed and configured to allow women to have ease in using the restroom without the need to drop or remove entire pair of pants 10.

Another feature of pair of pants 10 may be that open crotch area 12 and removable flap 13 of pair of pants 10 may be designed and configured to allow women to easily change, add, and/or adjust sanitary napkins 40 (see FIGS. 3-5, 6B and 7B).

Another feature of pair of pants 10 may be that open crotch area 12 and removable flap 13 of pair of pants 10 may be designed and configured to allow women to have ease in using the restroom without the need to drop and/or remove the entire pair of pants 10 and to allow women to easily change, add, or adjust sanitary napkins 40 (see FIGS. 3-5, 6B and 7B).

As best shown in FIGS. 3-5, 6B and 7B, in select embodiments of pair of pants 10, removable flap 13 may include lining material 41. Lining material 41 may be on underside 42 of removable flap 13. Underside 42 of removable flap 13 may be the side under removable flap 13 on inside of pair of pants 10 that may contact the wearer in open crotch area 12. Lining material 41 on underside 42 of removable flap 13 may be any type of desired material for underside 42 of removable flap 13. In select embodiments, lining material 41 may be configured to be breathable and/or comfortable and/or to absorb any moisture on underside 42 of removable flap 13. In select embodiments, lining material 41 on underside 42 of removable flap 13 may be, but is not limited to, cotton material 44. Wherein, removable flap 13 with cotton lined underside 42 may be configured to eliminate the need to wear underwear under pair of pants 10. This feature may allow easier use of pair of pants 10 with removable flap 13, like for allowing the wearer to use the restroom without removing or dropping pair of pants 10 and/or allowing the wearer to change, add, and/or adjust a sanitary napkin without the need to remove or drop pair of pants 10.

Figure 4:
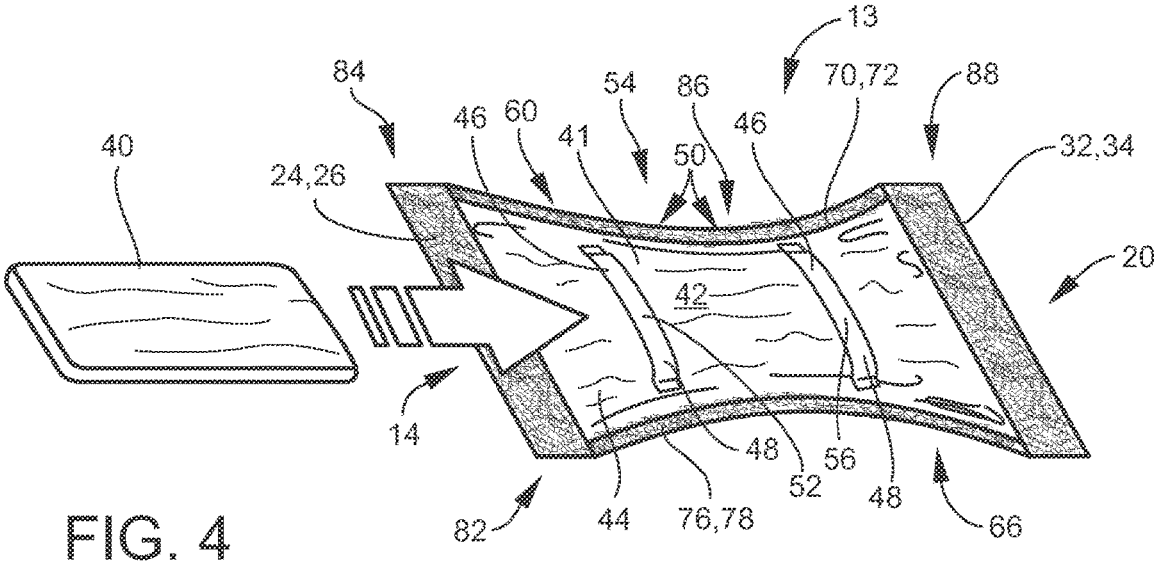
FIG. 4 is a perspective view of the removable flap for the disclosed pants according to select embodiments of the instant disclosure showing how a sanitary napkin can be inserted into the bands.
Figure 5:
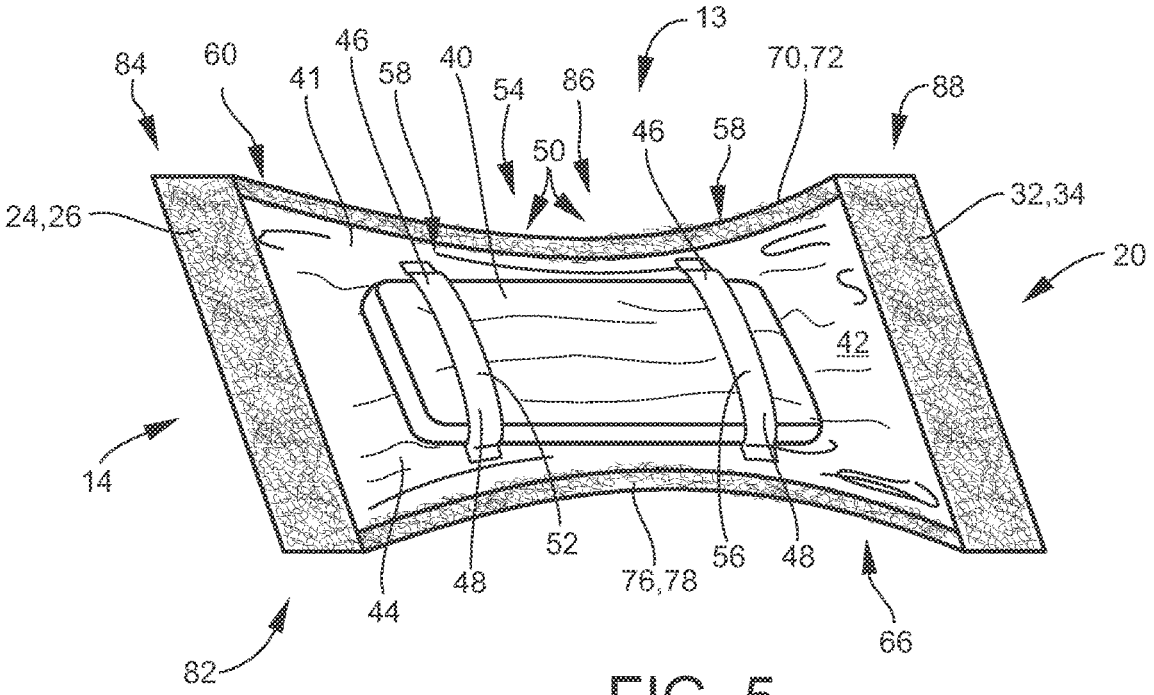
FIG. 5 is another perspective view of the removable flap from FIG. 4 with the sanitary napkin inserted under the two bands and held into position on the underside of the removable flap.

Still referring to FIGS. 3-5, 6B and 7B, and as best illustrated in FIGS. 4 and 5, in select embodiments of pair of pants 10, removable flap 13 may include at least one band 46 on underside 42 of removable flap 13. Each of the at least one band 46 may be designed and/or configured to secure sanitary napkin 40, or the like, on underside 42 of removable flap 13. Bands 46 may be positioned anywhere on removable flap 13 for securing sanitary napkin, or the like, on underside 42 and may include any orientation or number of bands 46 on removable flap 13. As shown in the Figures, in select embodiments, removable flap 13 may include, but is not limited to, two bands 50 on underside 42 of removable flap 13. The two bands 50 may include front band 52 and back band 56. Front band 52 may be positioned between middle 54 and front end 14 of removable flap 13. Back band 56 may be positioned between middle 54 and back end 20 of removable flap 13. Wherein, the two bands 50 (52 and 56) may be configured to secure sanitary napkin 40 in two securing locations 58 along underside 42 of removable flap 13 (as shown in FIG. 5). In select embodiments, each of the bands 46 may be made from soft elastic band material 48 (see FIG. 5). With bands 46 made from soft elastic band material 48, a user may lift up on each of the bands 46, thereby stretching the bands 46, insert sanitary napkin 40 or the like under the stretched bands 46 and into position on underside 42 of removable flap 13, and then release stretched bands 46 to secure the sanitary napkin 40 or the like on underside 42 of removable flap 13. The soft aspect of soft elastic band material 48 may be designed to provide comfort to the wearer.

As best shown in FIGS. 3, 6B and 7B, in select embodiments of pair of pants 10, removable flap 13 may include left flap side 60 and right flap side 66. Left flap side 60 of removable flap 13 may be designed to be removably fastened to left crotch side 62 of open crotch area 12 of pants 10 from frontside 18 of waistband 16 down between legs 64 and up to backside 22 of waistband 16. Likewise, right flap side 66 of removable flap 13 may be designed to be removably fastened to right crotch side 68 of open crotch area 12 of pants 10 from frontside 18 of waistband 16 down between legs 64 and up to backside 22 of waistband 16. In select embodiments, left flap side 60 of removable flap 13 and left crotch side 62 of open crotch area 12 may include left side fastening strip 70. Left side fastening strip 70 may be any type or means of providing a removable connection between left flap side 60 of removable flap 13 and left crotch side 62 of open crotch area 12 of pair of pants 10. As examples, and clearly not limited thereto, in select embodiments, left side fastening strip 70 may be, but is not limited to, left side hook and loop type fastener 72 (see FIGS. 1-5 and 7A-7B), left side zipper fastener 74 (see FIGS. 6A and 6B), the like, and/or any various combinations thereof. Likewise, right side fastening strip 76 may be any type or means of providing a removable connection between right flap side 66 of removable flap 13 and right crotch side 68 of open crotch area 12 of pair of pants 10. As examples, and clearly not limited thereto, in select embodiments, right side fastening strip 76 may be, but is not limited to, right side hook and loop type fastener 78 (see FIGS. 1-5 and 7A-7B), right side zipper fastener 80 (see FIGS. 6A and 6B), the like, and/or any various combinations thereof. Wherein, right side fastening strip 76 and left side fastening strip 70 may be configured to prevent gapping between removable flap 13 and open crotch area 12 of pair of pants 10.

As best shown in FIGS. 3, 4, 5, 6B and 7B, in select embodiments of pair of pants 10, removable flap 13 may include hourglass shape 82. Hourglass shape 82 of removable flap 13 may include front large width 84 at front end 14, narrow middle width 86 at middle 54, and back large width 88 at back end 20. Similarly, open crotch area 12 may have corresponding opening shape 90 configured to match the hourglass shape of the removable flap. Corresponding opening shape 90 of open crotch area 12 may include front wide opening 92 approximate frontside 18 of waistband 16, narrow middle opening 94 between legs 64 of pants 10, and back wide opening 96 approximate backside 22 of waistband 16.

One feature of the disclosed pair of pants 10 may be that they can be designed and/or configured to hold sanitary napkins 40, or the like, in place during hiking or other highly physical activities.

Another feature of the disclosed pair of pants 10 may be that they can be designed and/or configured to be safer and faster in using the bathroom in public or outdoor locations, such as camping or public events like festivals with long restroom lines, or for women who have to work outdoors, like female construction workers, police officers, firefighters, military personnel, etc.

Another feature of the disclosed pair of pants 10 may be that they can be designed and/or configured to avoid direct contact with restrooms that may not be sanitary.

Another feature of the disclosed pair of pants 10 may be that they can be designed and/or configured to have removable flap 13 be exchanged for mix and match look 98 (see FIGS. 1, 2, 6A and 7A).

Another feature of the disclosed pair of pants 10 may be the inclusion of a faux zipper front (not shown in the Figures). This faux zipper front may be designed and configured to make pair of pants 10 look normal so that wearers don't have to have pants that look different.

Another feature of the disclosed pair of pants 10 may be that they can be designed and/or configured to be used with much greater ease for people with disabilities, dexterity or mobility issues, either for more independence or to make it faster and easier for caretakers to assist with dressing and bathroom needs.

Another feature of the disclosed pair of pants 10 may be that they can be designed and/or configured to provide the ability to use the removeable flap 13 to change out completely to replace soiled flaps 13 or to simply push the flap 13 to the side or releasing front to back or back to front is faster and easier and allows the wearer to experience not only more efficiency, but dignity.

In another aspect, the instant disclosure embraces the disclosed pair of pants 10 in any of the various embodiments and/or combinations of embodiments shown and/or described herein.

In sum, the purpose of removable flap 13 on the disclosed pair of pants 10 may be to allow women to have ease in using the restroom without the need to remove the entire pair of pants 10 and to easily change, add, or adjust sanitary napkins 40, or the like. Removable flap 13 may cover open crotch are 12 and may be fastened near waistband 16 in the front and back (frontside 18 and backside 22). Removable flap 13 can be removed from either the front to the back or the back to the front as desired. Pair of pants 10 with removable flap 13 may eliminate the need for underwear because of the cotton-lined crotch (cotton material 44 on underside 42 of removable flap 13), and bands 46 can be used to hold sanitary napkins 40, or the like, in place. Depending on the style of pants 10, there may be a hook and loop type fastener, zipper, or other strip as needed along the sides in the front of removable flap 13 to prevent gapping in the front.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A pair of pants including:

an open crotch area in the pair of pants; and a removable flap integrally formed and configured to cover the open crotch area in the pair of pants, wherein the removable flap including:

a front end, the front end of the removable flap is configured to be removably fastened on a front side of a waistband of the pair of pants;

a back end, the back end of the removable flap is configured to be removably fastened on a back side of the waistband of the pair of pants;

the removable flap including an hourglass shape with a front large width at the front end, a narrow middle width at a middle, and a back large width at the back end;

the open crotch area having a corresponding opening shape configured to match the hourglass shape of the removable flap including a front wide opening adjacent the front side of the waistband, a narrow middle opening between legs of the pants, and a back wide opening adjacent the back side of the waistband;

the front end of the removable flap and the front side of the waistband of the pair of pants including a front removable connection, the front removable connection being selected from the group consisting of:

a front hook and loop type fastener connection;

a front plurality of buttons connection; and a front plurality of snaps connection;

the back end of the removable flap and the back side of the waistband of the pair of pants including a back removable connection, the back removable connection being selected from the group consisting of:

a back hook and loop type fastener connection;

a back plurality of buttons connection; and a back plurality of snaps connection;

a left flap side of the removable flap, the left flap side is designed to be removably fastened to a left crotch side of the open crotch area from the front side of the waistband down between the legs and up to the back side of the waistband; and a right flap side of the removable flap, the right flap side is designed to be removably fastened to a right crotch side of the open crotch area from the frontside of the waistband down between the legs and up to the back side of the waistband;

the left flap side of the removable flap and the left crotch side of the open crotch area including a left side fastening strip, the left side fastening strip is along the entire left crotch side and the left flap side from the front side of the waistband to the back side of the waistband, the left side fastening strip is selected from the group consisting of:

a left side hook and loop type fastener; and a left side zipper fastener;

the right flap side of the removable flap and the right crotch side of the open crotch area including a right side fastening strip, the right side fastening strip is along the entire right crotch side and the right flap side from the front side of the waistband to the back side of the waistband, the right side fastening strip is selected from the group consisting of:

a right side hook and loop type fastener; and a right side zipper fastener;

wherein the right side fastening strip and the left side fastening strip are configured to prevent gapping between the removable flap and the open crotch area;

the removable flap including a lining material on an underside of the removable flap, the lining material is configured to be breathable and comfortable and to absorb moisture on the underside of the removable flap, wherein the lining material on the underside of the removable flap is a cotton material, wherein the removable flap is configured to eliminate the need to wear underwear under the pair of pants;

the removable flap includes two bands on the underside of the removable flap, the two bands are configured to secure a sanitary napkin on the underside of the removable flap, wherein the removable flap including the two bands on the underside of the removable flap, the two bands including:

a front band positioned between a middle and the front end of the removable flap; and a back band positioned between the middle and the back end of the removable flap;

wherein, the two bands are configured to secure the sanitary napkin in two securing locations along the underside of the removable flap;

wherein each of the two bands are made from a soft elastic band material;

wherein, the removable flap is configured to be removed from the front side of the waistband and/or the back side of the waistband;

whereby, the removable flap is configured to be removed or attached from either the front side to the back side or the back side to the front side, as desired;

wherein, when the removable flap is positioned over the open crotch area with the front end of the removable flap fastened on the front side of the waistband and the back end of the removable flap fastened on the back side, the removable flap is configured to conceal the open crotch area;

wherein, when the removable flap is removed from the pair of pants by unfastening the front end and/or the back end of the removable flap from the waistband, the open crotch area is uncovered;

wherein the open crotch area and the removable flap of the pair of pants are designed and configured to allow women to have ease in using the restroom without the need to remove the entire pair of pants;

wherein the open crotch area and the removable flap of the pair of pants are designed and configured to allow the women to easily change, add, or adjust the sanitary napkin;

wherein the open crotch area and the removable flap of the pair of pants are designed and configured to allow the women to have ease in using the restroom without the need to remove the entire pair of pants and to allow the women to easily change, add, or adjust the sanitary napkin; and wherein, the pair of pants are designed and configured to:

hold the sanitary napkin in place during hiking or another physical activity;

allow the wearer to be safe and fast in using a bathroom in public or outdoor locations, including camping or public events including festivals with long restroom lines, or for women who work outdoors;

allow the wearer to avoid direct contact with restrooms that may not be sanitary; and have the removable flap be exchanged for a mix and match look.

* * * * *